US011926460B2

(12) United States Patent
Ritchie et al.

(10) Patent No.: US 11,926,460 B2
(45) Date of Patent: Mar. 12, 2024

(54) FOLDABLE PROTECTIVE TRANSPORTATION AND DISPLAY CONTAINER

(71) Applicant: Super Niche Brands, LLC, Murray, UT (US)

(72) Inventors: Shaun Ritchie, Murray, UT (US); Eric Gray, Layton, UT (US)

(73) Assignee: SUPER NICHE BRANDS, LLC, Murray, UT (US)

( * ) Notice: Subject to any disclaimer, the term of this patent is extended or adjusted under 35 U.S.C. 154(b) by 16 days.

(21) Appl. No.: 17/672,212

(22) Filed: Feb. 15, 2022

(65) Prior Publication Data

US 2023/0257181 A1 Aug. 17, 2023

(51) Int. Cl.

| | |
|---|---|
| ***B65D 5/42*** | (2006.01) |
| ***B65D 81/02*** | (2006.01) |
| *B65D 5/22* | (2006.01) |
| *B65D 77/04* | (2006.01) |

(52) U.S. Cl.

CPC ..... *B65D 81/025* (2013.01); *B65D 5/22* (2013.01); *B65D 77/0426* (2013.01)

(58) Field of Classification Search

CPC .. B65D 81/025; B65D 5/5009; B65D 5/5021; B65D 5/5052; B65D 5/5253; B65D 5/545; B65D 5/22; B65D 5/6632; B65D 5/48018; B65D 5/6638; B65D 5/5038; B65D 5/504; B65D 5/5042; B65D 71/243; B65D 77/0426

USPC ..... 206/774, 485, 562, 588, 446, 763; 229/143, 149, 120.08, 194, 178, 120.11

See application file for complete search history.

(56) References Cited

U.S. PATENT DOCUMENTS

| | | | | | |
|---|---|---|---|---|---|
| 1,551,139 | A * | 8/1925 | Dietsche, Jr. | B65D 5/5023 | 206/427 |
| 2,271,243 | A * | 1/1942 | Edmund | B65D 5/4801 | 229/120.04 |
| 2,284,815 | A * | 6/1942 | Grimm | B65D 5/4801 | 229/120.04 |
| 2,339,176 | A * | 1/1944 | Lee | B65D 5/5038 | 206/427 |
| 2,421,748 | A * | 6/1947 | Fink | B65D 5/5021 | 229/125.37 |
| 2,608,340 | A * | 8/1952 | Donnell | B65D 5/6632 | 229/130 |
| 2,719,665 | A * | 10/1955 | Tharpe | B65D 5/48048 | 229/117.14 |
| 3,208,079 | A * | 9/1965 | Thomas | B65D 5/48014 | 229/120.08 |
| 3,397,772 | A * | 8/1968 | Farquhar | B65D 5/5021 | 206/783 |
| 3,468,469 | A * | 9/1969 | Kossoff | B65D 5/6632 | 229/128 |

(Continued)

*Primary Examiner* — Gideon R Weinerth

(74) *Attorney, Agent, or Firm* — Travis Banta; Loyal IP Law, PLLC

(57) ABSTRACT

A foldable container that includes a top section, middle section, and a bottom section. The middle section is connected to both the top and the bottom sections. The top section includes a top first panel comprising one or more apertures sized to accommodate a top portion of one or more transport items. The bottom section includes a bottom first panel comprising one or more apertures sized to accommodate a bottom portion of one or more transport items.

18 Claims, 5 Drawing Sheets

(56) References Cited

U.S. PATENT DOCUMENTS

| | | | | |
|---|---|---|---|---|
| 4,214,696 | A * | 7/1980 | Barton | B65D 5/48018 229/120.04 |
| 5,184,772 | A * | 2/1993 | McGrath | B65D 5/6638 229/148 |
| 5,228,617 | A * | 7/1993 | McGrath | B65D 5/2057 229/148 |
| 5,934,549 | A * | 8/1999 | Baumgartner | B65D 5/422 229/92.8 |
| 7,097,043 | B2 * | 8/2006 | Hsu | B65D 5/22 229/120.04 |
| 7,334,686 | B2 * | 2/2008 | Filardi | B65D 5/2028 206/766 |
| 10,994,889 | B1 * | 5/2021 | Rumsam | B65D 5/5028 |
| 2004/0222109 | A1 * | 11/2004 | Pucillo | B65D 5/5021 206/216 |
| 2005/0023161 | A1 * | 2/2005 | Hsu | B65D 5/4801 206/320 |
| 2006/0231441 | A1 * | 10/2006 | Gomes | B65D 5/46088 206/427 |
| 2007/0228124 | A1 * | 10/2007 | Plescher | B65D 5/5495 229/120.01 |
| 2013/0048533 | A1 * | 2/2013 | McDonald | B65D 5/5021 206/591 |
| 2016/0167857 | A1 * | 6/2016 | Liu | B65D 5/5042 229/103.2 |
| 2018/0044054 | A1 * | 2/2018 | Saito | B65D 5/528 |
| 2022/0089312 | A1 * | 3/2022 | Meuti | B65D 5/5038 |
| 2022/0144480 | A1 * | 5/2022 | Royal | B65D 77/0426 |
| 2022/0315275 | A1 * | 10/2022 | Rumsam | B65D 5/22 |
| 2022/0315276 | A1 * | 10/2022 | Bandinu | B65D 5/5004 |

* cited by examiner

FOLDABLE PROTECTIVE TRANSPORTATION AND DISPLAY CONTAINER

TECHNICAL FIELD

The disclosure relates generally to a device that lies flat and then folded in a way that creates a protective carrier and a display container for display and conveyance of transportable items.

BACKGROUND

The history of packaging likely stems from the need to carry food and water. Gourds, baskets, and animal skins were first used to transport food and water. 3500 years ago, Egyptians created a glass container for storing water. The Chinese started using mulberry bark to transport food and over the centuries developed paper for food packaging. In France, the canning process was invented around the time of the Napoleonic wars and was perfected after they ended.

The early 1800s brought about the first cardboard box. By the mid 1800s a paper bag making machine was invented in the United States. Also, later in the United States the folding carton machine was invented and was used by Nabisco®. Not long after, William Kellogg started using cardboard boxes to package his cereal. Beer was first packaged in cans in the early 1900s and in the mid-1900s a pull tab made its debut onto the top of an aluminum can. Also, around the mid-1900s the plastic bottle was introduced and by the early 1980s plastic had become common packaging material for food and beverages. Some food producers still favor the glass bottle to plastic or other modern materials. Two challenges with glass are that it is heavy and breakable. The weight adds to shipping expenses and because of the fragility glass requires durable and often visually unflattering packaging. The presentation advantages of glass, however, may compensate for the weight and fragility. Glass looks nice and connotes quality and class. Many argue that glass better preserves the flavor of liquid inside a glass bottle. For example, wine was first placed in bottles in the 1600's and even today wines are frequently stored in glass bottles. Though wine bottles have changed shape since the 1600s, most wine bottles share a recognizable shape for storage and display purposes . . . .

It is the object of this disclosure to provide a packaging container that when not in use can be stored in a flat position. Further, the object of this disclosure is to provide a container that secures a fragile item for transportation while allowing the container to be opened and provide a visually flattering display for the transported items.

SUMMARY

Disclosed herein is a foldable container that includes a top section, middle section, and a bottom section. The middle section is connected to both the top and the bottom sections. The top section includes a top first panel comprising one or more apertures sized to accommodate a top portion of one or more transport items. The bottom section includes a bottom first panel comprising one or more apertures sized to accommodate a bottom portion of one or more transport items.

BRIEF DESCRIPTION OF THE DRAWINGS

Non-limiting and non-exhaustive implementations of the present disclosure are described with reference to the following figures, wherein like or similar reference numerals refer to like or similar parts throughout the various views unless otherwise specified. Advantages of the present disclosure will become better understood with regard to the following description and accompanying drawings.

DETAILED DESCRIPTION

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same or similar reference numbers are used throughout the drawings to refer to the same or similar parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
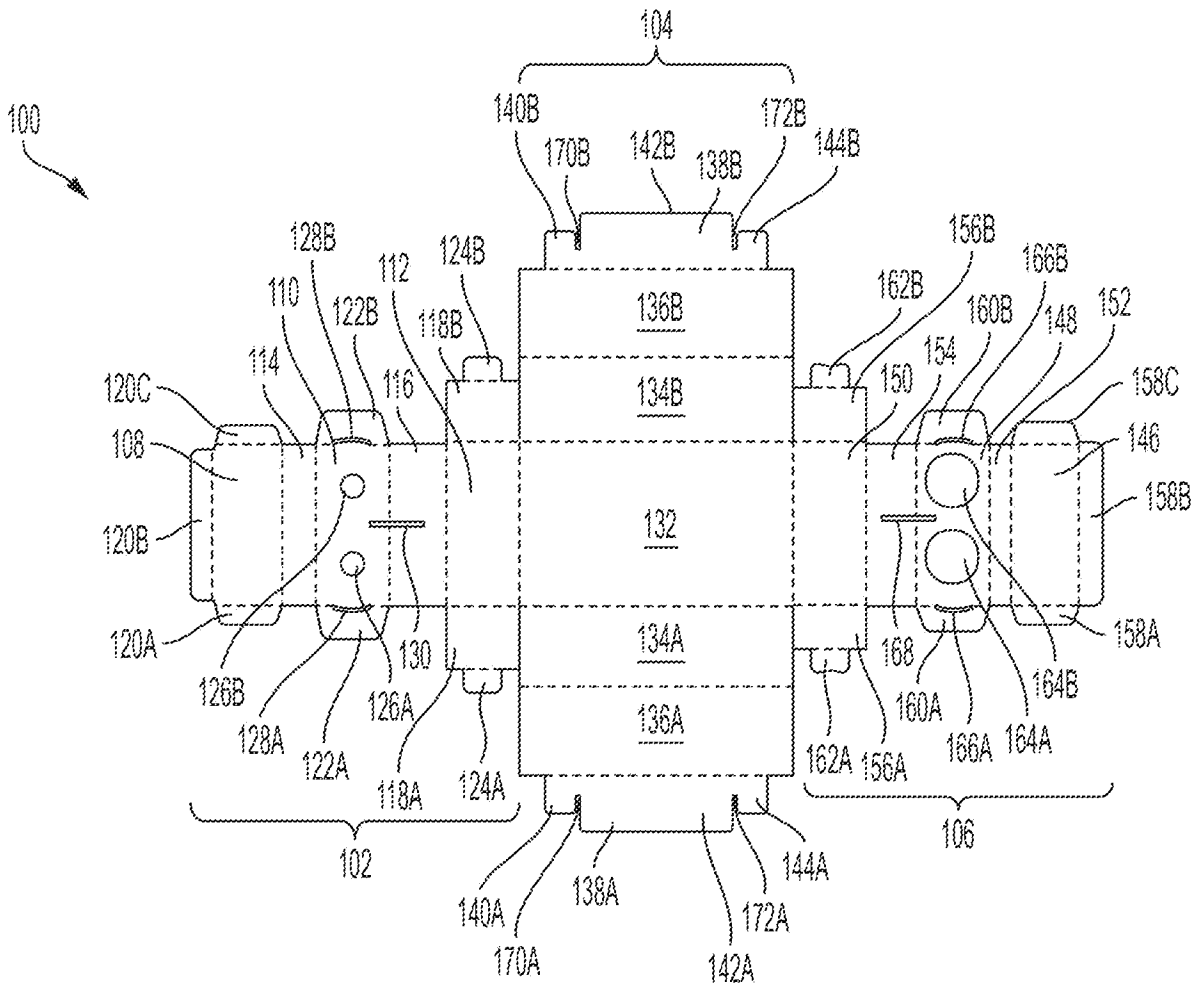
FIG. 1 illustrates a top unfolded front view of a protective transportation and display container.

FIG. 1 illustrates a top unfolded front view of a protective transportation and display container 100. Container 100 may include many materials exclusively or in combination with other material (e.g., cardboard, plastics, foam, rubber, wood, metal or other materials known to one of ordinary skill in the art). Container 100 may include three main sections: top section 102, middle section 104, and bottom section 106. The top section 102 is connected to middle section 104 by a flexible joint. Middle section 104 is connected to bottom section 106 by a flexible joint. Furthermore, sections, panels, dividers, spacers, and tabs may connect to another part of the container 100 using a flexible joint. Top section 102 may include three panels, top outside panel 108, top middle panel 110, and top inside panel 112. From outside to inside, each top panel may be successively narrower (i.e., top outside panel 108 may be narrower than top middle panel 110 and top middle panel 110 may be narrower than top inside panel 112. Further, top section 102 may include top proximal spacer 116 and top distal spacer 114. Top distal spacer 114 may connect to top outside panel 108 and top middle panel 110 by a flexible connector. Top distal spacer 114 may be narrower than top proximal spacer 116. Top outside panel 108 may connect to top left tab 120A top right tab 120C and top longitudinal tab 120B with a flexible joint. On the back side of top left and right tabs 120A and 120C may be adhesive, magnet, snap, hook and loop or other connectors known to one of ordinary skill in the art to connect to top middle panel 110. More specifically top left and right tabs 120A and 120C may attach to top left and right slotted tabs 122A and 122B that may be a portion of top middle panel 110. Top longitudinal tab 120B may include adhesive, magnet, snap, hook and loop or other connectors known to one of ordinary skill in the art to connect to top proximal spacer 116.

As mentioned above, top middle panel 110 may connect to top left slotted tab 122A and right slotted tab 122B with flexible joints. Top left and right slotted tabs 122A-B may include top left and right slot 128A-B respectively. Top left slot 128A, while container 100 is in a flat position, may be curved or arched away from the center of top middle panel 110. Correspondingly, top right slot 128B, while container 100 is in a flat position, may also curve away from the center of top middle panel 110. Further, top middle panel 110 may include top left aperture 126A and/or top right aperture 126B. Top left and right apertures 126A-B may be sized to allow the top end of the transport item(s) to be received. Alternatively, top left and right apertures 126A-B may be adjustable to fit the size of the one or more transport items. Also, included in top middle panel 110 may be top slit 130. The remaining portion of top slit 130 may be located on top proximal spacer 116. Connected to top proximal spacer 116 is top inside panel 112. Connected to proximal panel by a flexible joint may be top left and right end spacers 118A-B. Connected to top left and right end spacers 118A-B are top left and right key tabs 124A-B. Top left key tab 124A is connected to an outside end of top left end spacer 118A by a flexible joint. Top right key tab 124B is connected to an outside end of top right end spacer 118B by a flexible joint. Top left and right key tabs 124A and 124B are sized to fit into left top slot 128A and top right slot 128B respectively. For example, when top section 102 is folded, along the flexible joint, into display or transportation position the back side of top left slotted tab 122A may contact the front side of top left end spacer 118A. An adhesive or a connector may be used maintain the connection. Top left key tab 124A, after being inserted into left top left slot 128A, may be kept in place by friction created between the outside edges of top left slot 128A and top left key tab 124A. Further, this friction between top left key tab 124A and top left slot 128A may be increased by the curved or arched shape of top left slot 128A. A similar connection may be made between top right key tab 124B and top right slot 128B.

An exemplary manner to assemble top section 102 may be to lay container 100 on its back and bend top tabs 120A-C, along their flexible joints upwards or alternatively flat against outside of top outside panel 108 and then fold top outside panel 108 along the flexible joint located the edge opposite top longitudinal tab 120B towards the front side of top distal spacer 114. Top distal spacer 114 may be folded, along the flexible joint between top distal spacer 114 and top middle panel 110, towards the front side of top middle panel 110. Top slotted tabs 122A and 122B may be folded, along the flexible joint, upwards to top middle panel 110. Top middle panel 110 may then be folded, along the flexible joint towards top proximal spacer 116 along the flexible joint between top middle panel 110 and top proximal spacer 116. Subsequently, top proximal spacer 116 may be folded, along the flexible joint between top proximal spacer and top inside panel 112, toward the front side of top inside panel 112. After folding top proximal spacer 116 towards top inside panel 112 both top outside panel 108 and top middle panel 110 may be positioned above top inside panel 112 such that the bottom face of top middle panel 110 is facing upward with top left and right apertures 126A-B are open upwards. At this point, top left and right end spacers 118A-B may be folded, along the flexible joint located between left and right end spacers 118A-B and the left and right side of top inside panel 112, towards the center of top inside panel 112 Top left and right key tabs 124A-B may be folded, along the flexible joint between top left and right key tabs and corresponding top left and right end spacers 118A-B, to now folded top left and right end spacers 118A-B. Top left and right key tabs 124A-B may then be inserted into top left and right slot 128A and 128B respectively. After top left and right key tabs 124A-B are inserted into top left and right slot 128A and 128B respectively, top inside panel 112 may be folded, along the flexible joint between top inside panel 112 and back panel 132, towards the face of back panel 132 of middle section 104. After top inside panel 112 is folded, along the flexible joint, the back side of top proximal spacer 116 may be facing upwards exposing a portion of top slit 130. The back side of top middle panel 110 may be positioned more or less (plus or minus 20 degrees) perpendicular to the front of back panel 132 and the back of top inside panel 112 may be located opposite the back of top middle panel 110. The exposed portions of top section 102, once being folded, may be the back side of top inside panel 112 the back side of top proximal spacer 116, the back side of top middle panel 110, and the back side of left and right top end spacers 118A and 118B. Adhesive and/or connectors known to one of ordinary skill in the art may be used to further aid in keeping the folded top section 102 in place.

Bottom section 106 includes many similar parts to that of top section 102. In explaining bottom section 106 similar names will be used for similar parts but the word "top" will not be used in describing the parts of bottom section 106 to further distinguish from top section 102. Also, many similarly named parts function in a similar manner on both top section 102 and bottom section 106.

Bottom section 106 may include three panels, outside panel 146 middle panel 148 and inside panel 150. From outside to in, each panel may be successively narrower (i.e., outside panel 146 may be narrower than middle panel 148 and middle panel 148 may be narrower than inside panel 150). Further, bottom section 106 may include proximal spacer 154 and distal spacer 152. Distal spacer 152 may be positioned in between outside panel 146 and middle panel 148. Distal spacer 152 may be narrower than proximal spacer 154. Outside panel 146 may include left tab 158A right tab 158C and longitudinal tab 158B. Tabs 158A-C may include adhesive, magnet, snap, hook and loop or other connectors known to one of ordinary skill in the art to connect to middle panel 148. More specifically, left and right tabs 158A and 158C may attach to left and right slotted tabs 160A and 160B that may be a portion of middle panel 148. Longitudinal tab 158B may include adhesive, magnet, snap, hook and loop or other connectors known to one of ordinary skill in the art to connect to proximal spacer 154.

As mentioned above, middle panel 148 may include left slotted tab 160A and right slotted tab 160B. Left and right slotted tabs 160A-B may include left and right slots 166A-B respectively. Left slot 166A may be curved or arched away from the center of middle panel 148. Correspondingly, right slot 166B may also curve away from the center of middle panel 148. Further, middle panel 148 may include right aperture 164A and left aperture 164B. Left and right apertures 164A-B are sized to allow the bottom end of the transport item(s) to be inserted. Left and right apertures 164A-B may be sized slightly smaller than or the same size as the transport items allowing the items to be place in snugly. In an alternative embodiment, left and right apertures 164A-B may be adjustable to fit the size of the one or more transport items. Alternatively, left and right apertures 164A-B may be adjustable to fit the size of the transport items.

Also, included in middle panel 148 may be slit 168. The remaining portion of slit 168 may be located in proximal spacer 154. Connected to proximal spacer 154 is inside panel 150. On the outside edges of inside panel 150 are left end spacer 156A and right end spacer 156B. On the outer edges of left and right spacers 156A-B are left and right key tabs 162A-B. Left key tab 162A is attached to an outside end of left spacer 156A. Right key tab 162B is attached to an outside end of right end spacer 156B. Key tabs 162A and 162B are sized to fit into left slot 166A and right slot 166B respectively. Further, key tabs 162A-B may be curved on the outside edge to allow for the insertion of the transport item(s). For example, when bottom section 106 is folded, along the flexible joint, into display or transportation position the back side of left slotted tab 160A may contact the front side of left spacer 156A. Adhesive and/or a connector may be used maintain the connection. Left key tab 162A, after being inserted into left slot 166A, may be kept in place by friction created between the outside edges of left slot 166A and left key tab 162A. Further, this friction between left key tab 162A and left slot 166A may be increased by the curved or arched shape of left slot 166A. A similar connection may be made between right key tab 162B and right slot 166B. Alternatively, or in addition, the length of key tabs 162A-B may be used to stabilize the transport item and may create additional friction that may aid to keep key tabs 162A-B in place.

An exemplary manner to assemble bottom section 106 may be to lay container 100 on its back and bend tabs 158A-C upwards to flat against outside panel 146 and then folding outside panel 146 along the edge opposite longitudinal tab 158B towards the front side of distal spacer 152. Distal spacer 152 may be folded, along the flexible joint located between distal spacer 152 and middle panel 148, towards the front side of middle panel 148. Left and right slotted tabs 160A and 160B may be folded, along the flexible joint, upwards towards middle panel 148. Middle panel 148 may then be folded, along the flexible joint, towards proximal spacer 154 along the edge between middle panel 148 and proximal spacer 154. Subsequently, proximal spacer 154 may be folded, along the flexible joint located between proximal spacer 154 and inside panel 150, toward the front side of inside panel 150. After folding proximal spacer 154 towards inside panel 150 both outside panel 146 and middle panel 148 may be positioned above inside panel 150 such that the bottom face of middle panel 148 is facing upward with left and right apertures 164A-B open upwards. At this point, left and right end spacers 156A-B may be folded, along the flexible joint between left and right end spacers 156A-B and left and right side of inside panel 150, towards the center of inside panel 150. Left and right key tabs 162A-B may be folded, along the flexible joint between left and right key tabs 162A-B and left and right end spacers 156A-B, towards left and right end tabs 156A-B. Left and right key tabs 162A-B may then be inserted into left and right slots 166A and 166B respectively. After left and right key tabs 162A-B are inserted into left and right slots 166A and 166B respectively, inside panel 150 may be folded, along the flexible joint between inside panel 150 and back panel 132, towards the face of back panel 132 of middle section 104. After inside panel 150 is folded, along the flexible joint, the back side of proximal spacer 154 may be facing upwards exposing a portion of slit 168. The back side of middle panel 148 may be more or less (plus or minus 20 degrees) perpendicular to back panel 132 and the back of inside panel 150 may be located opposite the back middle panel 148. The exposed portion of bottom section 106, once folded, may include the back side of inside panel 150 the back side of proximal spacer 154, the back side of middle panel 148, and the back side of end spacers 156A and 156B. Adhesive and/or connectors may be used to further aid in keeping bottom section 106 in a folded configuration.

Middle section 104 may use top slit 130 and slit 168 to connect to both top section 102 and bottom section 106 in transportation mode. Alternatively middle section 104 may be opened to display the transportation item that may be held in place by one or more of top section 102 and bottom section 106. The top side of middle section 104 may include back panel 132, left and right side panels 134A-B, left and right upper panels 136A-B, left and right dividers 138A-B. The one or more front side members, including back panel 132, left and right side panels 134A-B, left and right upper panels 136A-B, left and right dividers 138A-B, may include an illustration or decoration. The illustrations and or decorations may aid in the display mode of the presentation of the one or more transportation items. For example, a top portion of the one or more transportation items may be secured in the top section 102 while a bottom portion of the one or more transportation items may be secured in the bottom section 106 while the middle section 104 is open. In this manner, the one or more transportation items may be displayed because the portion of the one or more transportation items not secured by either top section or bottom section 106 is exposed and is open to be seen. Left and right dividers 138A-B may further include left and right upper tabs 140A-B, left and right center tabs 142A-B, and left and right lower tabs 144A-B.

Left and right dividers 138A-B may include top left and right divisions 170A-B between the left and right center tabs 142A-B and the top left and right upper tabs 140A-B. This division may end prior to the border line between left and right upper panels 136A-B and left and right dividers 138A-B. Moreover, left and right dividers 138A-B may also include left and right divisions 172A-B between the left and right center tabs 142A-B and the left and right lower tabs 144A-B. This division may end prior to the border line between left and right upper panels 136A-B and left and right dividers 138A-B.

Left and right upper tabs 140A-B are sized to fit inside top slit 130 when top section 102 is folded, along the flexible joint, up in a transportation configuration. Upper tabs 140A-B may be held into place by friction, connectors (e.g., magnet, snap, hook and loop or other connectors known to one of ordinary skill in the art), and/or adhesive with one or more of top slit 130, top proximal spacer 116, top middle panel 110, and top longitudinal tab 120B.

Moreover, left and right lower tabs 144A-B are sized to fit inside slit 168 when bottom section 106 is folded up, along the flexible joints, in transportation mode. Lower tabs 144A-B may be held into place by friction, adhesive, and or connectors (e.g., magnet, snap, hook and loop or other connectors known to one of ordinary skill in the art) between itself and with one or more of slit 168, proximal spacer 154, top middle panel 148, and top longitudinal tab 158B.

Figure 2:
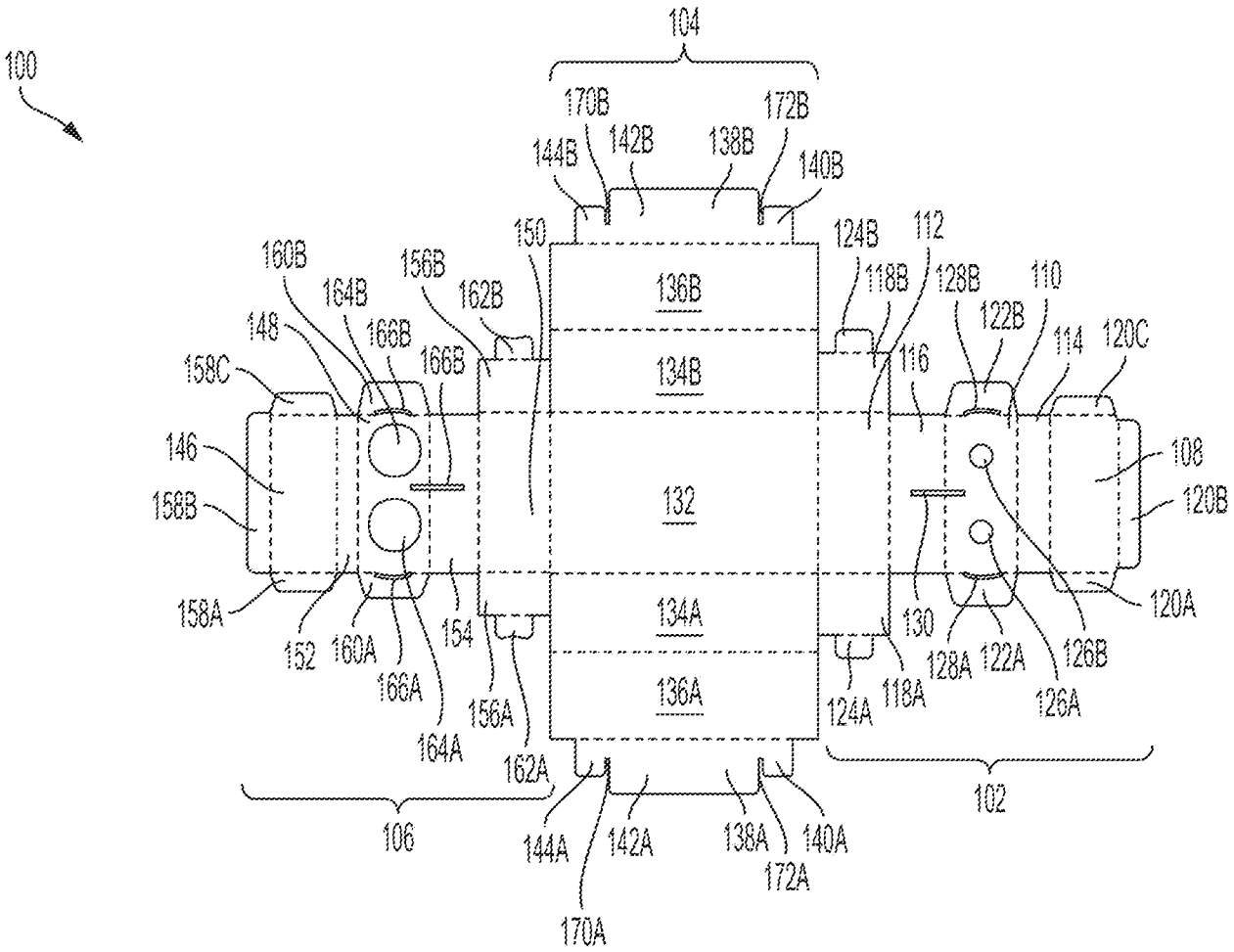
FIG. 2 illustrates a top unfolded back view of a protective transportation and display container.

FIG. 2 illustrates a top unfolded back view of a protective transportation and display container 100. Container 100 may include many materials exclusively or in combination with other material (e.g., cardboard, plastics, foam, rubber, wood, metal or other materials known to one of ordinary skill in the art). Container 100 may include three main sections top section 102, middle section 104, and bottom section 106. Top section 102 may include three panels, top outside panel 108, top middle panel 110, and top inside panel 112. From outside to inside, each top panel may be successively narrower (i.e., top outside panel 108 may be narrower than top middle panel 110 and top middle panel 110 may be narrower than top inside panel 112. Further, top section 102 may include top proximal spacer 116 and top distal spacer 114. Top distal spacer 114 may be positioned in between top outside panel 108 and top middle panel 110. Top distal spacer 114 may be narrower than top proximal spacer 116. Top outside panel 108 may include top left tab 120A top right tab 120C and top longitudinal tab 120B. Top left and right tabs 120A-C may include adhesive, magnet, snap, hook and loop or other connectors known to one of ordinary skill in the art to connect to top middle panel 110. More specifically top left and right tabs 120A and 120C may attach to top left and right slotted tabs 122A and 122B that may be portion of top middle panel 110. Top longitudinal tab 120B may include adhesive, magnet, snap, hook and loop or other connectors known to one of ordinary skill in the art to connect to top proximal spacer 116. Furthermore, sections, panels, dividers, spacers, and tabs may connect to another part of the container 100 using a flexible joint.

As mentioned above, top middle panel 110 may include top left slotted tab 122A and right slotted tab 122B. Top left and right slotted tabs 122A-B may include top slots 128A-B respectively. Top slot 128A may be curved or arched away from the center of top middle panel 110. Correspondingly, top right slot 128B may also curve away from the center of top middle panel 110. Further, top middle panel 110 may include top left aperture 126A and top right aperture 126B. Top left and right apertures 126A-B are sized to allow the top end of the transport item(s) to be inserted. Also, included in top middle panel 110 may be top slit 130. The remaining portion of top slit 130 may be located in top proximal spacer 116. Connected to top proximal spacer 116 is top inside panel 112. On the outside edges of top proximal spacer 116 extending along the length of top inside panel 112 are top left end spacer 118A and top right end spacer 118B. Extending outward in the same directions as end as top end spacers 118A and 118B are top left key tab 124A and top right key tab 124B. Top left key tab 124A is attached to an outside end of top left spacer 118A. Top right key tab 124B is attached to an outside end of top right spacer 118B. Top right and left key tabs 124B and 124A are sized to fit into right top slot 128B and top left slot 128A respectively. For example, when top section 102 is folded into display or transportation position the back side of top left slotted tab 122A may contact the front side of top left end spacer 118A. Adhesive or connectors may be used to maintain the connection. Top left key tab 124A, after being inserted into left top left slot 128A, may be kept in place by friction created between the outside edges of top left slot 128A and top left key tab 124A. Further, this friction, adhesive and/or other connectors may be used between top left key tab 124A and top left slot 128A. Friction may be increased by the curved or arched shape of top left slot 128A. A similar connection may be made between top right key tab 124B and top right slot 128B.

An exemplary manner to assemble top section 102 may be to lay container 100 on its back and bend top tabs 120A-C upwards to flat against outside of top outside panel 108 and then fold top outside panel 108 along the edge opposite top longitudinal tab 120B towards the front side of top distal spacer 114. Top distal spacer 114 may be folded towards the front side of top middle panel 110. Top slotted tabs 122A and 122B may be folded upwards more or less perpendicularly to top middle panel 110 (more or less means plus or minus 20 degrees). Top middle panel 110 may then be folded towards top proximal spacer 116 along the edge between top middle panel 110 and top proximal spacer 116. Subsequently, top proximal spacer 116 may be folded toward the front side of top inside panel 112. After folding top proximal spacer 116 towards top inside panel 112 both top outside panel 108 and top middle panel 110 may be positioned above top inside panel 112 such that the bottom face of top middle panel 110 is facing upward with top left and right apertures 126A-B are open upwards. At this point, top left and right end spacers 118A-B may be folded towards the center of top inside panel 112 and top left and right key tabs 124A-B may be folded towards top left and right end tabs 118A-B. Top left and right key tabs 124A-B may then be inserted into top left and right slots 128A and 128B respectively. After top left and right key tabs 124A-B are inserted into top left and right slot 128A and 128B respectively, top inside panel 112 may be folded towards the face of back panel 132 of middle section 104. After top inside panel 112 is folded the back side of top proximal spacer 116 may be facing upwards exposing a portion of top slit 130. The back side of top middle panel 110 may be facing on the inside toward the front of back panel 132 and the back of top inside panel 112 may be located opposite the back of top middle panel 110. The exposed portion of top section 102 once folded may be comprise the back side of top inside panel 112, the back side of top proximal spacer 116, the back side of top middle panel 110, and the back side of left and right top end spacers 118A and 118B. Adhesive and/or connectors may be used to further aid in keeping the folded top section 102 in place. Because of exposure the back sides of top proximal spacer 116, top middle panel 110 and end spacers 118A-B may include decoration such that when the container 100 is in display configuration, the decoration may add to the display. This decoration may coincide or complement decorations that may be on middle section 104.

The bottom section 106 includes many similar parts to that of the top section 102. In explaining bottom section 106 similar names will be used for similar parts but the word "top" will not be used in describing the parts of bottom section 106 to further distinguish from top section 102. Also, many similarly named parts function in a similar manner on both top section 102 and bottom section 106.

Bottom section 106 may include three panels, outside panel 146 middle panel 148 and inside panel 150. From outside to in, each panel may be successively narrower (i.e., outside panel 146 may be narrower than middle panel 148 and middle panel 148 may be narrower than inside panel 150. Further, bottom section 106 may include proximal spacer 154 and distal spacer 152. Distal spacer 152 may be positioned in between outside panel 146 and middle panel 148. Distal spacer 152 may be narrower than proximal spacer 154. Outside panel 146 may include left tab 158A right tab 158C and longitudinal tab 158B. Tabs 158A-C may include adhesive, magnet, snap, hook and loop or other connectors known to one of ordinary skill in the art to connect to middle panel 148. More specifically, left and right tabs 158A and 158C may attach to left and right slotted tabs 160A and 160B that are a portion of middle panel 148. Longitudinal tab 158B may include adhesive, magnet, snap, hook and loop or other connectors known to one of ordinary skill in the art to connect to proximal spacer 154. It is to be understood that adhesive, magnet, snap, hook and loop or other connectors known to one of ordinary skill in the art may be used at any contact point of container 100.

As mentioned above, middle panel 148 may include left slotted tab 160A and right slotted tab 160B. Left and right slotted tabs 160A-B may include left and right slots 166A-B respectively. Left slot 166A may be curved away from the center of middle panel 148. Correspondingly, right slot 166B may also curve away from the center of middle panel 148. Further, middle panel 148 may include right aperture 164A and left aperture 164B. Right and left apertures 164A-B are sized to allow the bottom end of the transport item(s) to be inserted. Left and right apertures 164A-B may be sized slightly smaller than or the same size as the transport items allowing the items to be place in snugly. Also, included in middle panel 148 may be slit 168. The remaining portion of slit 168 may be located in proximal spacer 154. Connected to proximal spacer 154 may be inside panel 150. Outside edges of inside panel 150 may include left end spacer 156A and right end spacer 156B. On the outer edges of left and right spacers 156A-B are left and right key tabs 162A-B. Left key tab 162A may be attached to an outside end of left spacer 156A. Right key tab 162B may be attached to an outside end of right end spacer 156B. Key tabs 162A and 162B are sized to fit into left slot 166A and right slot 166B respectively. Further, key tabs 162A-B may be curved or arched on the outside edge to allow for the insertion of the transport item(s). For example, when bottom section 106 is folded into display or transportation position the back side of left slotted tab 160A may contact the front side of left spacer 156A. Adhesive or a connector may be used maintain the connection. Left key tab 162A, after being inserted into left slot 166A, may be kept in place by friction created between the outside edges of left slot 166A and left key tab 162A. Further, this friction between left key tab 162A and left slot 166A may be increased by the curved arched shape of left slot 166A. A similar connection may be made between right key tab 162B and right slot 166B. Alternatively, or in addition, the length of key tabs 162A-B may be adjusted to stabilize the transport item and may create additional friction that may aid to keep key tabs 162A-B in place.

An exemplary manner to assemble bottom section 106 may be to lay container 100 on its back and bend tabs 158A-C upwards or flat against top outside panel 108 and then fold outside panel 146 along the edge opposite longitudinal tab 158B towards the front side of distal spacer 152. Distal spacer 152 may be folded towards the front side of middle panel 148. Left and right slotted tabs 160A and 160B may be folded upwards. Middle panel 148 may then be folded towards proximal spacer 154 along the edge between middle panel 148 and proximal spacer 154. Subsequently, proximal spacer 154 may be folded toward the front side of inside panel 150. After folding proximal spacer 154 towards inside panel 150 both outside panel 146 and middle panel 148 may be positioned above inside panel 150 such that the bottom face of middle panel 148 is facing upward with left and right apertures 164A-B open upwards. At this point, left and right end spacers 156A-B may be folded towards the center of inside panel 150 and left and right key tabs 162A-B may be folded to now folded left and right end tabs 156A-B. Left and right key tabs 162A-B may then be inserted into left and right slots 166A and 166B respectively. Afterwards, left and right key tabs 162A-B may be inserted into left and right slots 166A and 166B respectively. Inside panel 150 may then be folded towards the face of back panel 132 of middle section 104. After inside panel 150 is folded the back side of proximal spacer 154 may be facing upwards exposing a portion of slit 168. The back side of middle panel 148 may be facing on the inside toward the front of back panel 132 and the back of inside panel 150 may be located opposite the back middle panel 148. The exposed portion of top section 102 once folded may comprise the back side of inside panel 150, the back side of proximal spacer 154, the back side of middle panel 148, and the back side of end spacers 156A and 156B.

Adhesive and/or other connectors may be used to further aid in keeping the folded bottom section 106 in place. Because of exposure, the back sides of proximal spacer 154, middle panel 148, and end spacers 156A-B may include decoration such that when the container 100 is in a display configuration the decoration may add to the display. This decoration may coincide or complement decorations that may be on middle section 104.

Middle section 104 may use top slit 130 and slit 168 to connect to both top section 102 and bottom section 106 in transportation mode. Alternatively middle section 104 may be opened to display the transportation item that may be held in place by one or more of top section 102 and bottom section 106. The bottom Side of middle section 104 may include back panel 132, left and right side panels 134A-B, left and right upper panels 136A-B, left and right dividers 138A-B. The one or more back members, including back panel 132, left and right side panels 134A-B, left and right upper panels 136A-B, left and right dividers 138A-B may include an illustration or decoration. The illustrations and or decorations may aid in the presentation of the one or more transportation items. For example, a top portion the one or more transportation items may be secured in the top section 102 while a bottom portion of the one or more transportation items may be secured in the bottom section 106 while the middle section 104 is open. In this manner, the one or more transportation items may be displayed because the portion of the one or more transportation item not secured by either top section 102 or bottom section 106 is exposed and is open to be seen.

Middle section 106 may include left and right dividers 138A-B that may further include left and right upper tabs 140A-B, left and right center tabs 142A-B, and left and right lower tabs 144A-B. Left and right dividers 138A-B may include top left and right divisions 170A-B between the left and right center tabs 142A-B and the top left and right upper tabs 140A-B. This division may end prior to the border line between left and right upper panels 136A-B and left and right dividers 138A-B. Moreover, left and right dividers 138A-B may also include left and right divisions 172A-B between the left and right center tabs 142A-B and the left and right lower tabs 144A-B. This division may end prior to the border line between left and right upper panels 136A-B and left and right dividers 138A-B.

Left and right upper tabs 140A-B are sized to fit inside top slit 130 when top section 102 is folded up in transportation mode. Upper tabs 140A-B may be held into place by friction with one or more of top slit 130, top proximal spacer 116, top middle panel 110, and top longitudinal tab 120B. Alternatively, one or more of upper tabs 140A-B, top slit 130, top proximal spacer 116, top middle panel 110, and top longitudinal tab 120B may include adhesive, magnet, snap, hook and loop or other connectors known to one of ordinary skill in the art.

Moreover, left and right lower tabs 144A-B may be sized to fit inside slit 168 when bottom section 106 is folded up in transportation mode. Left and right upper tabs 140A-B may be held into place by friction, adhesive, and or connectors (e.g., magnet, snap, hook and loop or other connectors known to one of ordinary skill in the art) with one or more of slit 168, top proximal spacer 154, middle panel 148, and top longitudinal tab 158B.

Figure 3:
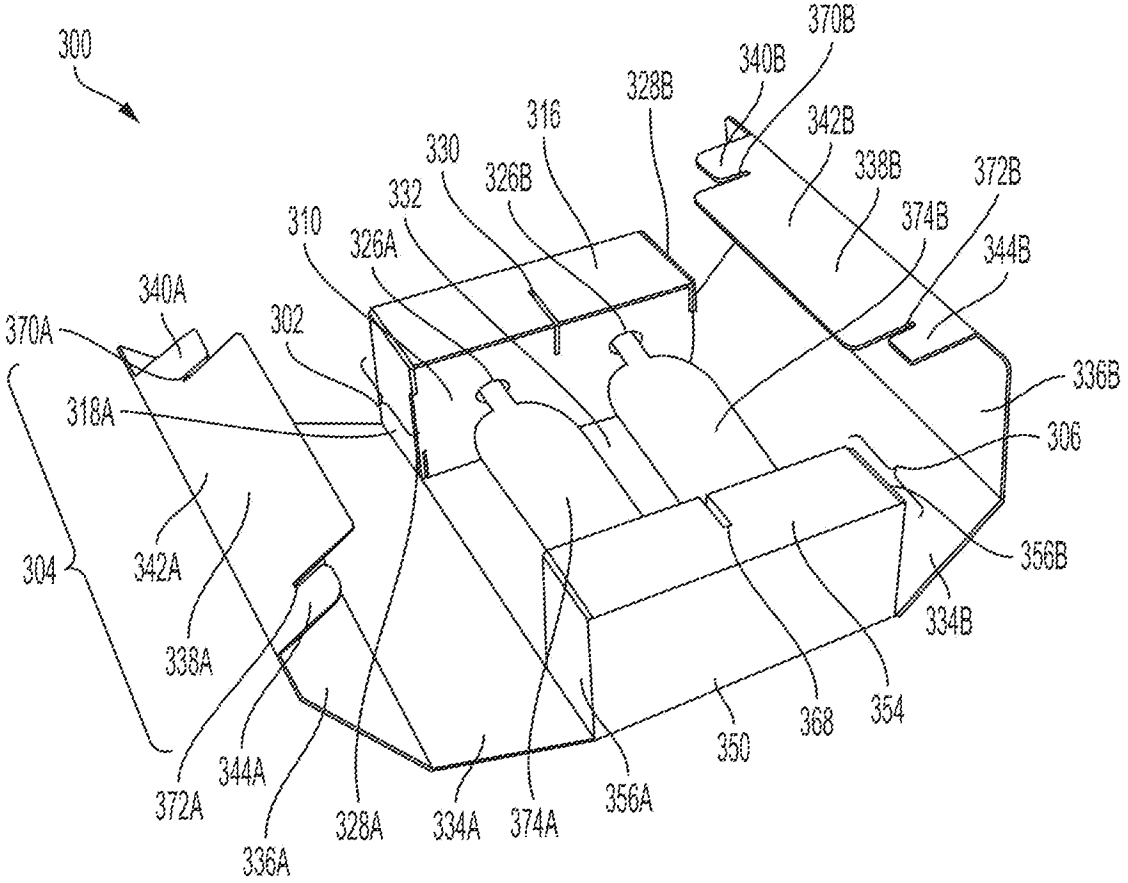
FIG. 3 illustrates a perspective view of a protective transportation and display container in a display position.

FIG. 3 illustrates a perspective view of a protective transportation and display container 300 in a display mode. Container 300 may include many materials exclusively or in combination with other material (e.g., cardboard, plastics, foam, rubber, wood, metal or other materials known to one of ordinary skill in the art). Container 300 may include three main sections top section 302, middle section 304, and bottom section 306. Top section 302 may include three panels, top outside panel (similar to top outside panel 108 shown in FIGS. 1 and 2 but not shown in FIG. 3 due to perspective), top middle panel 310, and top inside panel (similar to top inside panel 112 shown in FIGS. 1 and 2 but not shown in FIG. 3 due to perspective). From outside to inside, each top panel may be successively narrower (i.e., top outside panel may be narrower than top middle panel 310 and top middle panel 310 may be narrower than top inside panel. Further, top section 302 may include top proximal spacer 316 and top distal spacer (similar to top distal spacer 114 shown in FIGS. 1 and 2 but not shown in FIG. 3 due to perspective). Top distal spacer may be positioned in between top outside panel and top middle panel 310. Top distal spacer may be narrower than top proximal spacer 316. Top outside panel may include a top left tab, top right tab, and top longitudinal tab (similar to top left and right tabs 120A-C spacer shown in FIGS. 1 and 2 but not shown in FIG. 3 due to perspective). The back side of top left and right tabs may include adhesive, magnet, snap, hook and loop or other connectors known to one of ordinary skill in the art to connect to top middle panel 310. Moreover, adhesive, magnet, snap, hook and loop or other connectors known to one of ordinary skill in the art may be used at any connection point of container 310. More specifically, top left and right tabs may attach to top left and right slotted tabs (similar to top left and right slotted tabs 122A-B as shown in FIGS. 1 and 2 but not shown in FIG. 3 due to perspective) are a portion of top middle panel 310. Top longitudinal tab may include adhesive, magnet, snap, hook and loop or other connectors to connect to top proximal spacer 316. Furthermore, sections, panels, dividers, spacers, and tabs may connect to another part of the container 300 using a flexible joint.

As mentioned above, top middle panel 310 may include a top left slotted tab and right slotted tab. The top left and right slotted tabs may include top left 328 and a right top slot (similar to top right slots 128B shown in FIGS. 1 and 2 but not shown in FIG. 3 due to perspective). Left top slot 328A may be curved or arched away from the center of top middle panel 310 when container 330 is laying open and in a flat configuration. Correspondingly, right top slot may also curve away from the center of top middle panel 310 when container 330 is laying open and in a flat configuration. Further, top middle panel 310 may include top left aperture 326A and top right aperture 326B. Top left and right apertures 326A-B are sized to allow the top end of the transport items 374A-B to be inserted. Apertures 326A-B may be adjustable to different transport items 374A-B inserted. The exemplary transport items 374A-B are depicted as wine bottles (or similar bottles containing various beverages or liquids) and apertures 326A-B are sized to fit the top portion of transportation items 374A-B. Also, included in top middle panel 310 may be top slit 330. The remaining portion of top slit 330 may be located in top proximal spacer 316. Connected to top proximal spacer 316 may be the top inside panel. On the outside edges of top proximal spacer 316 extending along the length of the top proximal panel are top left end spacer 318A and top right end spacer 318B. When laying in on open and flat configuration top key tabs (similar to top left and right key tabs 124A-B shown in FIGS. 1 and 2 but not shown in FIG. 3 due to perspective) extend outward in the same directions as top end spacers 318A-B respectively. The top left key tab is attached to an outside end of top left end spacer 318A. The top right key tab is attached to an outside end of top right end spacer 318B. The top left and right key tabs are sized to fit into top left slot 328A and top right slot 328B respectively. For example, when top section 302 is folded into display or transportation position the back side of the top left slotted tab may contact the front side of top left end spacer 318A. Adhesive or a connector may be used maintain the connection. Top left key tab after being inserted into top left slot 328A, may be kept in place by friction created between the outside edges of the top left slot 328A and top left key tab (similar to top left key tab 124A shown in FIGS. 1 and 2 but not shown in FIG. 3 due to perspective). Further, this friction between the top left key tab and top left slot 328A may be increased by the curved or arched shape of top left slot 328A. A similar connection may be made between the top right key tab and the top right slot.

An exemplary manner to assemble top section 302 may be to lay container 300 on its back in an open and flat configuration and bend the top tabs upwards more or less perpendicularly or alternatively flat against outside of top outside panel and then folding the top outside panel along the edge opposite top longitudinal tab towards the front side of the top distal spacer. The top distal spacer may be folded towards the front side of top middle panel 310. The top slotted tabs may be folded upwards more or less perpendicularly to top middle panel 310 (more or less means plus or minus 20 degrees). Top middle panel 310 may then be folded towards top proximal spacer 316 along the edge between top middle panel 310 and top proximal spacer 316. Subsequently, top proximal spacer 316 may be folded toward the front side of the top inside panel. After folding top proximal spacer 316 towards the top inside panel both the top outside panel and top middle panel 310 may be positioned above the top inside panel such that the bottom face of top middle panel 310 is facing upward with top left and right apertures 326A-B are open upwards. At this point, top left and right end spacers 318A-B may be folded towards the center of the top inside panel and the top left and right key tabs may be folded more or less perpendicularly to top left and right end spacers 318A-B. The top left and right key tabs may then be inserted into top left slot 328A and right slot and respectively. After the top left and right key tabs are inserted into top left slot 328A and right slot respectively, the top inside panel may be folded towards the face of back panel 332 of middle section 304. After the top inside panel is folded the back side of top proximal spacer 316 may be facing upwards exposing a portion of top slit 330. The back side of top middle panel 310 may be facing on the inside toward the front of back panel 332 and the back of the top inside panel may be located opposite the back of top middle panel 310. The exposed portion of top section 302 once folded may be the back side of the top inside panel, the back side of top proximal spacer 316, the back side of top middle panel 310, and the back side of left and right top end spacers 356A and 356B. Adhesive and connectors may be used to further aid in keeping the folded top section 302 in place.

The bottom section 306 includes many similar parts to that of the top section 302. In explaining bottom section 306 similar names will be used for similar part but the word "top" will not be used in describing the parts of bottom section 306 to further distinguish from top section 302. Also, many similarly named parts function in a similar manner on both top section 302 and bottom section 306.

Bottom section 306 may include three panels, the outside panel (similar to outside panel 146 shown in FIGS. 1 and 2 but not shown in FIG. 3 due to perspective), middle panel (similar to middle panel 148 shown in FIGS. 1 and 2 but not shown in FIG. 3 due to perspective) and inside panel 350. From outside to in, each panel may be successively narrower (i.e., the outside panel may be narrower than the middle panel and the middle panel may be narrower than inside panel 350. Further, bottom section 306 may include proximal spacer 354 and distal spacer (similar to distal spacer 152 shown in FIGS. 1 and 2 but not shown in FIG. 3 due to perspective). The distal spacer may be positioned in between the outside panel and the middle panel. The distal spacer may be narrower than proximal spacer 354. The outside panel 346 may include a left tab, a right tab, and a longitudinal tab (similar to top tabs 158A-C shown in FIGS. 1 and 2 but not shown in FIG. 3 due to perspective). The back side of the tabs may include adhesive, magnet, snap, hook and loop or other connectors known to one of ordinary skill in the art to connect to the middle panel. More specifically, the left and right tabs may attach to a left and a right slotted tab (similar to top left and right slotted tabs 160A-B shown in FIGS. 1 and 2 but not shown in FIG. 3 due to perspective) that are a portion of the middle panel. The longitudinal tab may include adhesive, magnet, snap, hook and loop or other connectors known to one of ordinary skill in the art to connect to proximal spacer 354.

As mentioned above, the middle panel may include the left slotted tab and the right slotted tab. The left and right slotted tabs may each include a slot respectively (similar to left and right slots 166A-B shown in FIGS. 1 and 2 but not shown in FIG. 3 due to perspective). The left slot 328A may be curved or arched away from the center of the middle panel. Correspondingly, the right slot may also curve away from the center of the middle panel. Further, the middle panel may include a right aperture and a left aperture (similar to top right aperture 164A and left 164B shown in FIGS. 1 and 2 but not shown in FIG. 3 due to perspective). The left and right apertures are sized to allow the bottom end of the transport items 374A-B to be inserted. Left and right apertures may be sized slightly smaller than the transport items 374A-B allowing the items to be place in snugly. Also, slit 368 may be included in the middle panel. The remaining portion of slit 368 may be located in proximal spacer 354. Connected to proximal spacer 354 is inside panel 350. On the outside edges of inside panel 350 are left end spacer 356A and right end spacer 356B. On the outer edges of left and right spacers 356A-B are left and right key tabs (similar to left and right key tabs 162A-B shown in FIGS. 1 and 2 but not shown in FIG. 3 due to perspective). The left key tab is attached to an outside end of left spacer 356A. The right key tab is attached to an outside end of right end spacer 356B. The left and right key tabs are sized to fit into left and right slot (similar to top left and right slots 166A-B shown in FIGS. 1 and 2 but not shown in FIG. 3 due to perspective) respectively. Further, the left and right key tabs may be curved on the outside edge to allow for the insertion of the transport items 374A-B. For example, when top section 302 is folded into display or transportation position the back side of the left slotted tab (similar to left slotted tab 160A shown in FIGS. 1 and 2 but not shown in FIG. 3 due to perspective) may contact the front side of left end spacer 356A. Adhesive or a connector may be used to maintain the connection. The left key tab may be kept in place by friction created between the outside edges of the left slot 328A and the left key tab. Further, this friction between the left key tab and the left slot 328A may be increased by the curved or arched shape of the left slot 328A. A similar connection may be made between the right key tab and the right slot. Alternatively, or in addition, the length of the left and right key tabs may be used to stabilize the transport items 374A-B and may create additional friction that may aid to keep the left and right key tabs in place.

An exemplary manner to assemble bottom section 306 may be to lay container 300 on its back and bend the tabs on the outside panel upwards perpendicularly or flat against the outside panel and then folding the outside panel along the edge opposite the longitudinal tab towards the front side of the distal spacer. The distal spacer may be folded towards the front side of the middle panel. Slotted tabs (similar to slotted tabs 160A-B shown in FIGS. 1 and 2 but not shown in FIG. 3 due to perspective) may be folded upwards more or less perpendicularly to the middle panel (more or less means plus or minus 20 degrees). The middle panel may then be folded towards proximal spacer 354 along the edge between middle panel and proximal spacer 354. Subsequently, proximal spacer 354 may be folded toward the front side of inside panel 350. After folding proximal spacer 354 towards inside panel 350 both the outside panel and the middle panel may be positioned above inside panel 350 such that the bottom face of the middle panel is facing upward with the left and right apertures open upwards. At this point, left and right end spacers 156A-B may be folded towards the center of inside panel 350 and the left and right key tabs may be folded more or less perpendicular to now folded left and right end tabs 356A-B (more or less means plus or minus 20 degrees). The left and right key tabs may then be inserted into left and right slots respectively. After the left and right key tabs may be inserted into the left and right slots respectively, inside panel 350 may be folded towards the face of back panel 332 of middle section 304. After inside panel 350 is folded, the back side of proximal spacer 354 may be facing upwards, exposing a portion of slit 368. The back side of the middle panel may be facing on the inside toward the front of back panel 332 and the back of inside panel 350 may be located opposite the back of the middle panel. The exposed portion of top section 302 once folded may be the back side of inside panel 350, the back side of proximal spacer 354, the back side of the middle panel, and the back side of end spacers 356A and 356B. Adhesive and/or connectors may be used to further aid in keeping folded bottom section 306 in place.

Middle section 304 may use top slit 330 and slit 368 to connect to both top section 302 and bottom section 306 in transportation mode. Alternatively, middle section 304 may be opened to display transportation items 374A-B that may be held in place by one or more of top section 302 and bottom section 306 such that transport items 374A-B may not touch the panels (332A-B, 334A-B, 336A-B, 338A-B) of middle section 304. The top side of middle section 304 may include back panel 332, left and right side panels 334A-B, left and right upper panels 336A-B, left and right dividers 338A-B. The one or more front side members, including back panel 332, left and right side panels 334A-B, left and right upper panels 336A-B, left and right dividers 338A-B may include an illustration or decoration.

Left and right dividers 338A-B may include top left and right divisions 370A-B between the left and right center tabs 342A-B and the top left and right upper tabs 340A-B. This division ends prior to the border line between left and right upper panels 336A-B and left and right dividers 338A-B.

Moreover, left and right dividers 338A-B may also include left and right divisions 372A-B between the left and right center tabs 342A-B and the left and right lower tabs 344A-B. This division ends prior to the border line between left and right upper panels 336A-B and left and right dividers 338A-B Left and right upper tabs 340A-B are sized to fit inside top slit 330 when top section 302 is folded up in transportation mode. Left and right upper tabs 340A-B may be held into place by friction with one or more of top slit 330, top proximal spacer 316, top middle panel 310, and the top longitudinal tab. Alternatively, one or more of upper tabs 340A-B, top slit 330, top proximal spacer 316, top middle panel 310, and the top longitudinal tab may include adhesive, magnet, snap, hook and loop or other connectors known to one of ordinary skill in the art.

Moreover, left and right lower tabs 344A-B are sized to fit inside slit 368 when bottom section 306 is folded up in transportation mode. Left and right upper tabs 340A-B may be held into place by friction with one or more of top slit 330, top proximal spacer 316, top middle panel 310, and the top longitudinal tab. Alternatively, one or more of left and right upper tab 340A-B, top slit 330, top proximal spacer 316, top middle panel 310, and the top longitudinal tab may include adhesive, magnet, snap, hook and loop or other connectors known to one of ordinary skill in the art.

Figure 4:
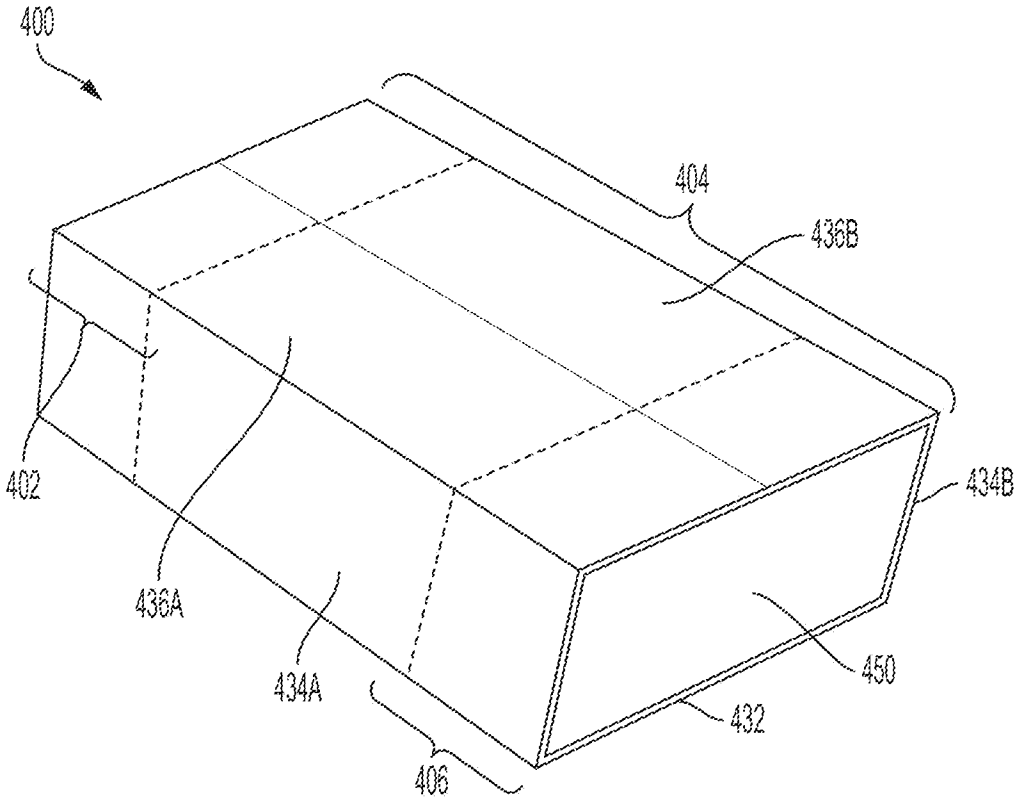
FIG. 4 illustrates a perspective view of a closed protective transportation and display container in a transportation position.

FIG. 4 illustrates a perspective view of a closed transportation and display container 400 in a transportation mode. Container 400 may include many materials exclusively or in combination with other material (e.g., cardboard, plastics, foam, rubber, wood, metal, or other materials known to one of ordinary skill in the art). Container 400 may include three main sections top section 402, middle section 404, and bottom section 406. Top section 402 may be used to secure the top end of one or more transportation items. Top section 402 may include top left and right apertures (similar to top left and right apertures 126A-B shown in FIGS. 1 and 2 but not shown in FIG. 4 due to perspective) to help secure transportation items. Bottom section 406 may include left and right apertures (similar to left and right top 164A-B shown in FIGS. 1 and 2 but not shown in FIG. 4 due to perspective) to help secure transportation items. Middle section 404 may include back panel 432, left and right panel 434A-B, left and right upper panels 436A-B, and left and right dividers (similar to top left and right dividers 138A-B shown in FIGS. 1 and 2 and 338A-B in FIG. 3 but not shown in FIG. 4 due to perspective). The outside of container 400 in a transportation configuration may include portions of bottom section 406, middle section 404, and top section 402. From bottom section 406 the outside of the container 400 may include inside panel 450. From the top section 402 the outside of the container 400 may include top inside panel (similar to top inside panel 112 as shown in FIGS. 1 and 2 but not shown in FIG. 4 due to perspective). From the middle section 404 the outside of the container 400 includes back panel 432 left and right panel 434A-B, and left and right upper panels 436A-B. The left and right divider in middle section 404 may include left and right upper tabs (similar to top left and right upper tabs 140A-B shown in FIGS. 1 and 2 and 340A-B in FIG. 3 but not shown in FIG. 4 due to perspective).

Also, top section 402 may include top slit (similar to top slit 130 shown in FIGS. 1 and 2 and 330 in FIG. 3 but not shown in FIG. 4 due to perspective). The left and right upper tabs may be inserted into the top slit to close container 400 around the transportation items. Moreover, the left and right divider in middle section 404 may include left and right lower tabs (similar to top left and right lower tabs 144A-B shown in FIGS. 1 and 2 and 344A-B in FIG. 3 but not shown in FIG. 4 due to perspective). Also, bottom section 406 may include slit (similar to slit 168 shown in FIGS. 1 and 2 and 368 in FIG. 3 but not shown in FIG. 4 due to perspective). The left and right lower tabs may be inserted into the slit to close container 400 around the transportation items. Further, middle section 404 may include right and left center tab (similar to left and right center tabs 142A-B shown in FIGS. 1 and 2 and 342A-B in FIG. 3 but not shown in FIG. 4 due to perspective). Center tab may be used to separate one or more transportation items placed in transportation container 400. Accordingly, by closing container 400 a user may cover, secure, protect, and insulate the transportation items.

Figure 5A:
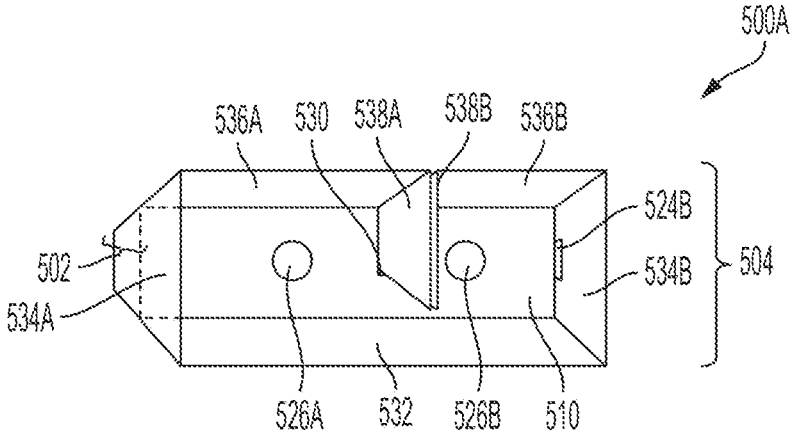
FIG. 5A illustrates a sectional view of the top end of a protective transportation and display container.

FIG. 5A illustrates a cross sectional view of the top end of a protective transportation and display container 500. Container 500 may include many materials exclusively or in combination with other material (e.g., cardboard, plastics, foam, rubber, wood, metal, or other materials known to one of ordinary skill in the art). Container 500 may include three main sections top section 502, middle section 504, and bottom section 506 (shown in FIG. 5B but not shown in 5A). Top section 502 may be used to secure the top end of one or more transportation items. Top section 502 may include top left and right apertures 526A and 526B to help secure transportation items. Top left and right apertures 526A-B may be sized to snuggly fit transportation items such that transportation items may be suspended away from panels of the middle section 504. In an alternative embodiment, top left and right apertures 526A-B may be adjustable to fit the size of the one or more transport items. Further, top left and right apertures 526A-B may further contain a rubber stopper, or similar cushioning means known to one of ordinary skill in the art, around the lip of top left and right apertures 526A-B to cushion and secure the transportation items. Also, top apertures 546A-B may be shaped in a way to keep transportation items from sliding in and out of top left and right apertures 526A-B. When top section 502 is folded upwardly, top middle panel 510 is positioned toward the middle of container 500 but not extending to the middle of container 500. Further, top left key tab (similar to top left key tab 124A as shown in FIGS. 1 and 2 but not shown in FIG. 5A due to perspective) and top right key tab 524B may be used to help keep top section in a folded position to be able to expose top left and right apertures 526A-B to receive one or more transportation items.

Middle section 504 may be folded up into transportation mode to protect, secure and insulate transportation items. To fold middle section 504 each panel may be folded towards back panel 532 such that left and right side panels 534A-B may be positioned as the left and right sides of container 500 and left and right upper panels 536A-B may be positioned at the upper portion of container 500 on opposite side of to back panel 532. Left and right dividers 538A-B may be folded inward such that left and right dividers 538A-B are positioned more or less parallel to left and right side panels 534A-B. Top section 502 attaches to middle section 504 between top inside panel (similar to top inside panel 112 as shown in FIGS. 1 and 2 but not shown in FIG. 5A due to perspective) of top section 502 and back panel 532. To put container 500 into transportation configuration, left and right dividers 538A-B may connect to top slit 530. Top slit 530 may be located on both top middle panel 510 and top proximal spacer (similar to top proximal spacer 116 shown in FIGS. 1 and 2 but not shown in FIG. 5A due to perspective). Top slit 530 may receive left and right upper tabs (similar to left and right upper tab 140A-B shown in FIGS. 1 and 2 but not shown in FIG. 5A due to perspective). The left and right upper tabs may be attached to left and right dividers 538A-B respectively. Left and right dividers 538A-B may include top left and right divisions (similar to top left and right divisions 170A-B shown in FIGS. 1 and 2 but not shown in FIG. 5A due to perspective) between the left and right center tabs 542A-B and the left and right upper tabs. The top divisions end prior to the border line between left and right upper panels 536A-B and top left and right dividers 538A-B. Accordingly, top slit 530 is found on both top middle panel 510 and top proximal spacer.

Figure 5B:
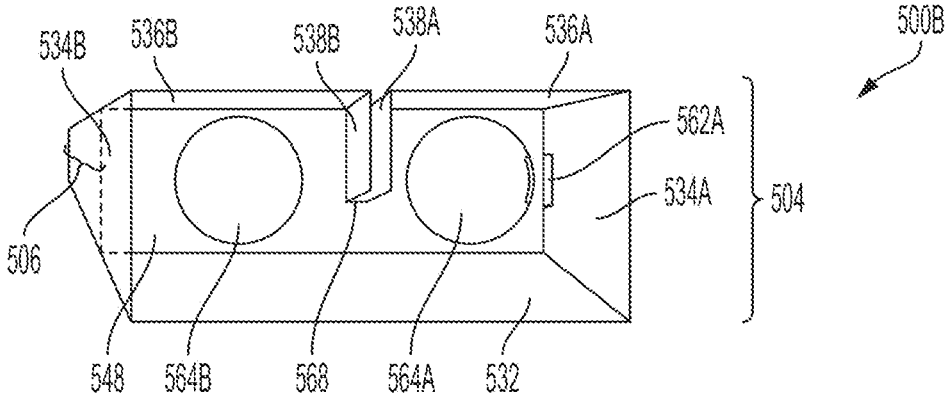
FIG. 5B illustrates a sectional view of the bottom end of a protective transportation and display container.

FIG. 5B illustrates a sectional view of the bottom end of a protective transportation and display container 500. Container 500 may include many materials exclusively or in combination with other material (e.g., cardboard, plastics, foam, rubber, wood, metal, or other materials known to one of ordinary skill in the art). Container 500 may include three main sections top section 502, middle section 504, and bottom section 506 (shown in FIG. 5B but not shown in FIG. 5A). Bottom section 506 may be used to secure the top end of one or more transportation items. Bottom section 506 may include left and right apertures 564A and 564B to help secure transportation items. Left and right apertures 564A-B may be sized to snugly fit transportation items such that transportation items may be suspended away from panels of the middle section 504. Further, apertures 564A-B may further contain a rubber stopper or other cushioning device known to one of ordinary skill in the art around the lip of left and right apertures 564A-B to cushion and secure the transportation items. Also, left and right apertures 564A-B may be shaped in a way to keep transportation items from sliding in and out of left and right apertures 564A-B. When bottom section 506 is folded up, middle panel 548 is positioned to face toward the middle of container 500 but not extending to the middle of container 500. Further, top left key tab (similar to top left key tab 124A as shown in FIGS. 1 and 2 but not shown in FIG. 5B due to perspective) and left key tab 562A may be used to help keep bottom section 506 in a folded position to be able to expose left and right apertures 564A and 564B to receive one or more transportation items.

Middle section 504 may be folded up into transportation mode to protect, secure and insulate transportation items. To fold middle section 504 each panel may be folded towards back panel 532 such that left and right side panels 534A-B may be positioned as the left and right sides of container 500 and left and right upper panels 536A-B may be positioned at the upper portion of container 500 on the opposite side of back panel 532. Left and right dividers 538A-B may fold inward such that left and right dividers 538A-B are positioned more or less parallel to left and right side panels 534A-B. Bottom section 506 attaches to middle section 504 between top inside panel (similar to top inside panel 112 as shown in FIGS. 1 and 2 but not shown in FIG. 5B due to perspective) of top section 502 and back panel 532. To put container 500 into transportation mode, left and right dividers 538A-B may connect to slit 568. Slit 568 may be located on both middle panel 548 and proximal spacer (similar to proximal spacer 154 shown in FIGS. 1 and 2 but not shown in FIG. 5A due to perspective). Slit 568 may receive left and right lower tabs (similar to left and right lower tabs 144A-B shown in FIGS. 1 and 2 but not shown in FIG. 5B due to perspective). The left and right lower tabs may be attached to left and right dividers 538A-B respectively. Left and right dividers 538A-B may include left and right divisions (similar to left and right divisions 172A-B shown in FIGS. 1 and 2 but not shown in FIG. 5B due to perspective) between the left and right center tabs 542A-B and the left and right lower tabs. Divisions 172A-B end prior to the border line between left and right upper panels 536A-B and left and right dividers 538A-B. Accordingly slit 568 is found on both middle panel 548 and the proximal spacer.

What is claimed is:

1. A foldable container comprising:

a top section comprising:

a top first panel that includes one or more apertures to accommodate a top portion of one or more transportation items, wherein the first top panel includes a tab that extends beyond the outside edge of the top first panel comprising:

a slot, wherein the slot included in the tab of the first top panel is arched;

a middle section connected to the top section; and a bottom section connected to the middle section, the bottom section comprising:

a bottom first panel that includes one or more apertures to accommodate a bottom portion of the one or more transportation items.

2. The foldable container of claim 1, wherein the top section further includes a top spacer.

3. The foldable container of claim 2, wherein the top section further includes a top slit.

4. The foldable container of claim 3, wherein the top slit is situated in both the top first panel and the top spacer.

5. The foldable container of claim 1, wherein the bottom section further includes a bottom spacer.

6. The foldable container of claim 5, wherein the bottom section further includes a bottom slit.

7. The foldable container of claim 6, wherein the bottom slit is situated in both the bottom first panel and the spacer.

8. The foldable container of claim 7, wherein the top panel further comprises:

a top key tab sized to fit into the top panel slot.

9. The foldable container of claim 1, wherein the bottom first panel includes a slot.

10. The foldable container of claim 9, wherein the bottom first panel slot is arched.

11. The foldable container of claim 10, wherein the top panel further comprises:

a bottom key tab sized to fit into the bottom first panel slot.

12. The foldable container of claim 1, wherein the middle section includes a back panel.

13. The foldable container of claim 12, wherein the top first panel folds along a flexible joint towards the back panel of the middle section.

14. The foldable container of claim 12, wherein the bottom first panel folds along a flexible joint towards the back panel of the middle section.

15. The foldable container of claim 7, wherein the middle section includes a divider.

16. The foldable container of claim 15, wherein the divider includes an upper tab and a lower tab.

17. The foldable container of claim 16, wherein the upper tab is sized to fit into the top slit of the top section.

18. The foldable container of claim 16, wherein the lower tab is sized to fit into the bottom slit of the bottom section.

* * * * *